United States Patent [19]

Jacobson

[11] Patent Number: 4,492,025

[45] Date of Patent: Jan. 8, 1985

[54] RAZOR HANDLE ASSEMBLY

[75] Inventor: Chester F. Jacobson, Southboro, Mass.

[73] Assignee: The Gillette Company, Boston, Mass.

[21] Appl. No.: 537,073

[22] Filed: Sep. 29, 1983

Related U.S. Application Data

[63] Continuation-in-part of Ser. No. 419,203, Sep. 17, 1982.

[51] Int. Cl.[3] ..... B26B 21/52

[52] U.S. Cl. ..... 30/87; 30/57

[58] Field of Search ..... 30/57, 87, 89

[56] References Cited

U.S. PATENT DOCUMENTS

| | | | |
|---|---|---|---|
| 3,938,247 | 2/1976 | Carbonell | 30/57 |
| 3,950,849 | 4/1976 | Perry | 30/57 |
| 4,094,063 | 6/1978 | Trotta | 30/87 |
| 4,266,340 | 5/1981 | Bowman | 30/89 |
| 4,403,414 | 9/1983 | Kiraly | 30/87 |

*Primary Examiner*—Jimmy C. Peters

*Attorney, Agent, or Firm*—Scott R. Foster

[57] ABSTRACT

A razor handle assembly comprising a grip portion, a head portion at one end of the grip portion having first and second shell bearings mounted thereon, the shell bearings being adapted to receive a razor blade assembly for pivotal movement on the handle, and a spring-biased plunger disposed in the head portion and extending between the first and second shell bearings, the plunger being reciprocally movable, the free end of the plunger being adapted to engage an underside cam portion of the blade assembly to exercise a bias on the blade assembly and thereby urge the blade assembly to a given position on the shell bearings.

2 Claims, 10 Drawing Figures

RAZOR HANDLE ASSEMBLY

CROSS-REFERENCE TO RELATED APPLICATION

This is a continuation-in-part of application Ser. No. 419,203, filed Sept. 17, 1982 in the name of Chester F. Jacobson.

BACKGROUND OF THE INVENTION

1. Field of the Invention

The invention relates to wet shaving implements and is directed more particularly to a razor handle assembly on which a blade assembly is pivotally movable during a shaving operation.

2. Description of the Prior Art

It is known in the art to provide a razor handle assembly which may be connected to, and used in conjunction with, a razor blade assembly to facilitate shaving operations. U.S. Pat. No. 3,768,162, issued Oct. 30, 1973, in the name of Roger L. Perry shows a razor handle assembly adapted to receive and retain a blade assembly.

It is further known that shaving efficiency may be improved if the blade assembly is adapted to pivot on the razor handle during a shaving operation, permitting the blade assembly to more closely follow the contours of a surface being shaved. U.S. Pat. No. 3,935,639, issued Feb. 3, 1976, in the name of John C. Terry, et al, and U.S. Pat. No. 3,938,247, issued Feb. 17, 1976, in the name of Nelson C. Carbonell, et al, are illustrative of razor handles adapted to accept blade assemblies in such manner as to permit pivotal movement of the blade assembly during a shaving operation. U.S. Pat. No. 4,026,016, issued May 31, 1977, in the name of Warren I. Nissen, and U.S. Pat. No. 4,083,104, issued Apr. 11, 1978, in the name of Warren I. Nissen, illustrate, respectively, a blade assembly and razor handle comprising a shaving system in which the blade assembly pivots on the handle during shaving. The shaving system shown in the '016 and '104 patents has become well known world-wide. However, it is sometimes difficult to discern whether the blade assembly is squarely on the small pivot mounting journals of the handle. As a consequence, shaving operations are sometimes begun with the cartridge attached to only one journal, or neither journal.

SUMMARY OF THE INVENTION

An object of the present invention is to provide a razor handle assembly, which provides the benefits of the U.S. Pat. No. 4,083,104-type handle, but by a more secure pivot mounting means which is more easily discerned by the eye of an operator.

With the above and other objects in view, as will hereinafter appear, a feature of the present invention is the provision of a safety razor handle assembly comprising a grip portion, a head portion at one end of the grip portion, the head portion having first and second shell bearings mounted thereon and adapted to receive a razor blade assembly and to permit pivotal movement of the razor blade assembly on the handle assembly, and a spring-biased plunger disposed in the head portion and extending between the first and second shell bearings, the plunger being reciprocally movable in the head portion, the free end of the plunger being adapted to engage an underside cam portion of the blade assembly to exercise a bias on the blade assembly and thereby urge the blade assembly to a given position on the shell bearings.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
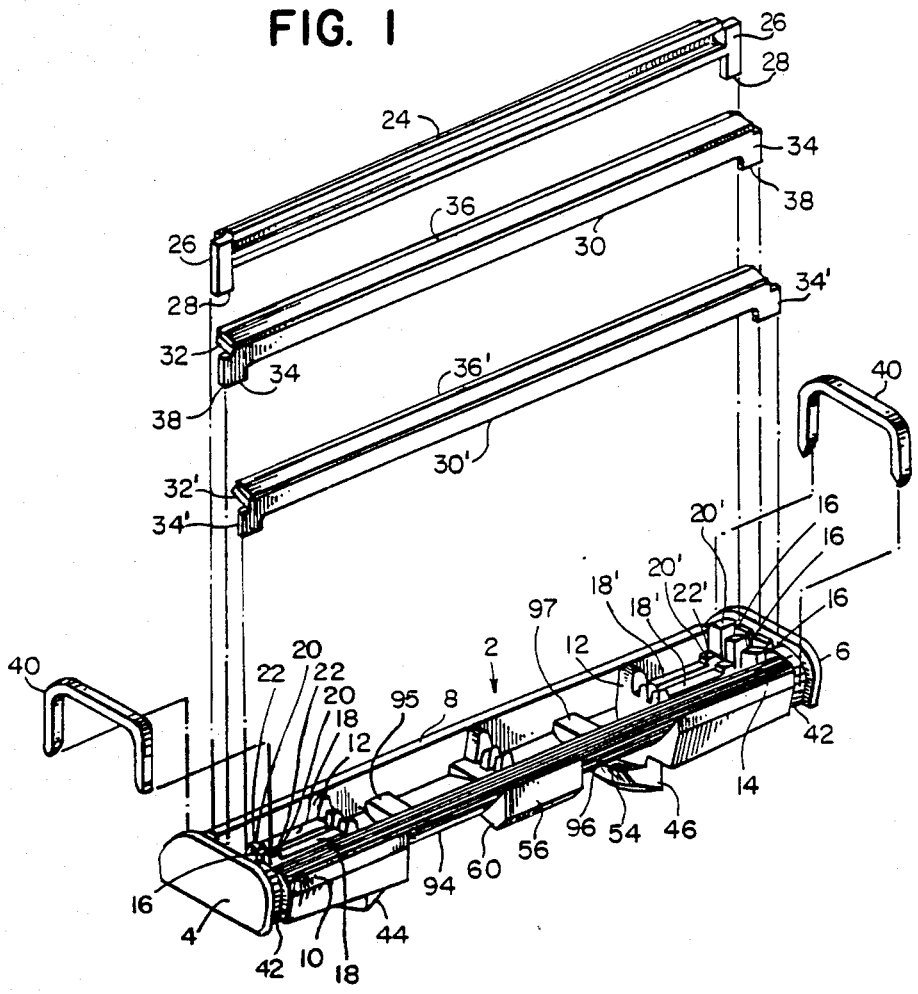
FIG. 1 is an exploded perspective view of one form of blade assembly suitable for use with the invention.
Figure 2:
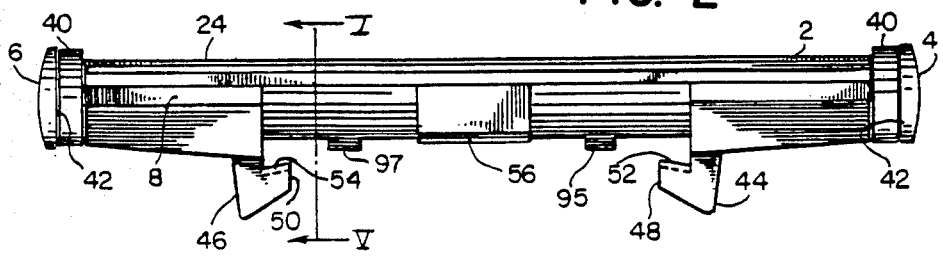
FIG. 2 is a front elevational view thereof.

Referring to the drawings, it will be seen that the illustrative razor blade assembly includes a body member 2 having first and second end portions 4, 6 interconnected by front and back wall portions 8, 10. Frame portions 12 extend width-wise of the body member, interconnecting the front and back walls 8, 10.

The back wall portion 10 of the body member 2 has an upper portion 14 which engages skin being shaved behind the cutting means of the assembly, thereby fulfilling the functions and occupying the position of the "cap" portion of conventional razor blade assemblies. Such portion 14 shall, for that reason, be referred to hereinafter as the "cap portion".

Each of the end portions 4, 6 is provided with opposed slots 16 disposed transversely to the frame portions 12. One of the frame members 12 near the first end portion 4 is provided with spring fingers 18 extending therefrom generally parallel to the front and back walls 8, 10. Each of the fingers 18 is provided with an upturned end portion 20 having an upper surface 22. In like manner, another of the frame members 12 near the second end portion 6 is provided with spring fingers 18' of similar configuration, with upturned end portions 20' having upper surfaces 22'. The fingers 18, 18' extend in opposite directions, the fingers 18 extending toward the first end portion 4 of the body member 2 and the fingers 18' extending toward the second end portion 6 of the body member. The fingers 18 and the fingers 18' are aligned with each other and with the slots 16.

The assembly includes a guard portion 24 having a slide member 26 at either end thereof. The slide members 26 are received in a pair of opposed slots 16 nearest the front wall portion 8. The bottom of the guard portion rests upon the surfaces 22, 22' of a pair of the spring fingers 18, 18'. The lower edges 28 of the slide members 26 rest above the bottoms of their slots 16, allowing the guard portion 24 to be moved further into the slots, against the bias of the spring fingers therebeneath. The spring fingers supporting the guard portion comprise a set of spring fingers, the object of which is to resiliently support the guard portion. In a shaving operation, the guard portion travels over the surface being shaved ahead of the cutting means.

The assembly further includes blade means comprising a blade support including a base portion 30, a platform portion 32 extending from the base portion, slide portions 34 at either end of the base portion, and a blade 36 fixed to the platform portion. The slide portions 34 are received in a pair of the opposed slots 16, with a bottom edge of the base portion 30 resting upon the surfaces 22, 22' of a second pair of the spring fingers 18, 18'. Lower edges 38 of the slide portions 34 are spaced from the bottoms of their slots to permit movement of the blade support base portion further into the slots 16 against the bias of the spring fingers 18, 18' on which the blade support base portion rests. The spring fingers supporting the blade support comprise another set of spring fingers, the object of which is to resiliently support the blade means thereon.

In the embodiment illustrated, the blade means include a second blade support including a base portion 30', a platform portion 32', slide portions 34' and blade 36', all anchored similarly to the above-described first blade support. The slide portions 34' are received in a third pair of the opposed slots 16 nearest the cap portion 14 with the base portion 30' resting upon spring finger surfaces. The spring fingers supporting the second blade support comprise still another set of spring fingers, which resiliently support the second blade. In a shaving operation, the second blade travels over the surface being shaved behind the first blade.

The guard portion 24, first and second blades 36, 36' are clamped in place by spring clamps 40, which are received in slots 42 in the end portions 4, 6. The clamps 40 engage the guard portion 24 and blades 36, 36', forcing them into the slots 16 to a point where a slight stress is placed on the spring fingers 18, 18'.

Figure 4:
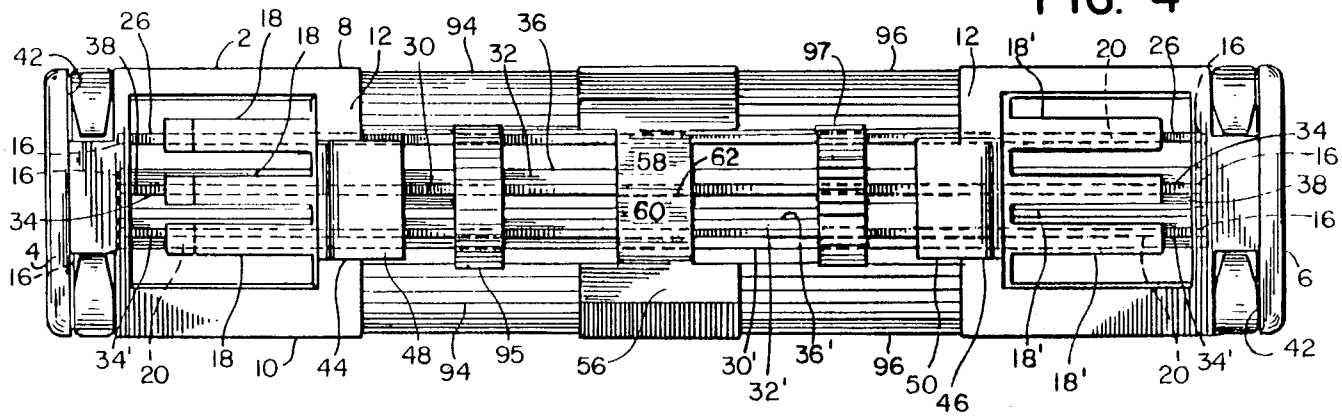
FIG. 4 is a bottom plan view thereof.
Figure 5:
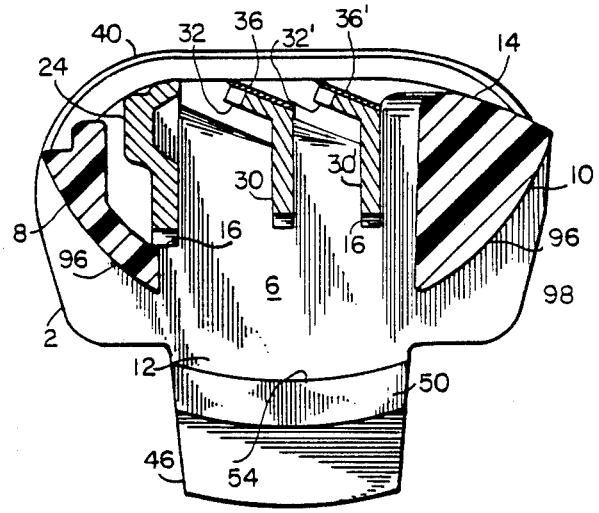
FIG. 5 is a sectional view, taken along line V—V of FIG. 2.

On the underside of the body member 2 and the frame portions 12, are disposed two extensions 44, 46 having at their free ends, respectively, inwardly extending opposed rails 48, 50, each rail having respective arcuate upper surfaces 52, 54. As will be further discussed below, the extensions comprise a pivot mounting means by which the blade assembly may be removably and pivotally attached to a razor handle. Referring to FIGS. 4 and 5, it will be seen that the blade assembly body member underside is additionally provided with cam means 56 comprising surfaces 58 and 60 joining at an apex 62, the surfaces 58, 60 defining therebetween an obtuse angle. As will be further described below, the cam means 56 is adapted to receive a cam follower operative to urge the blade assembly to a given position.

Figure 6:
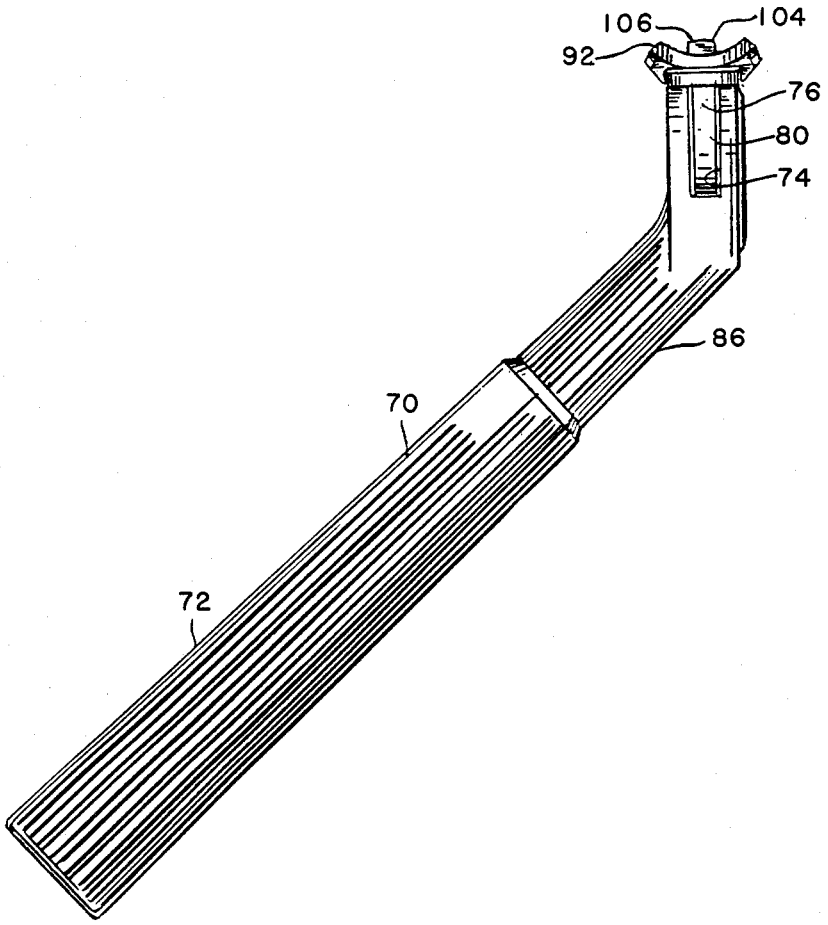
FIG. 6 is a side elevational view of one form of handle assembly illustrative of an embodiment of the invention.
Figure 7:
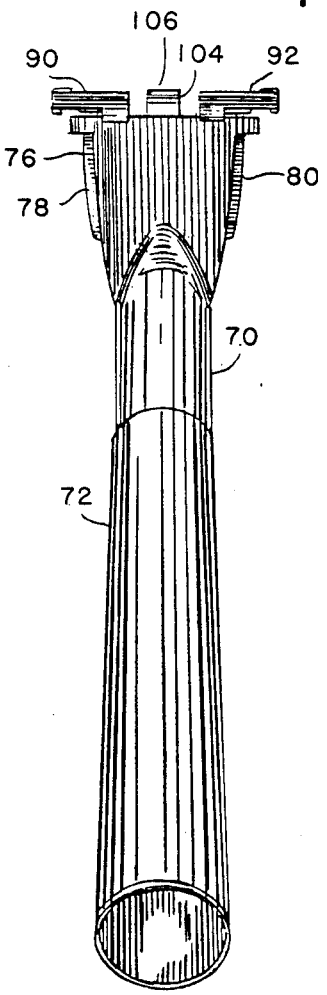
FIG. 7 is a front elevational view thereof.
Figure 8:
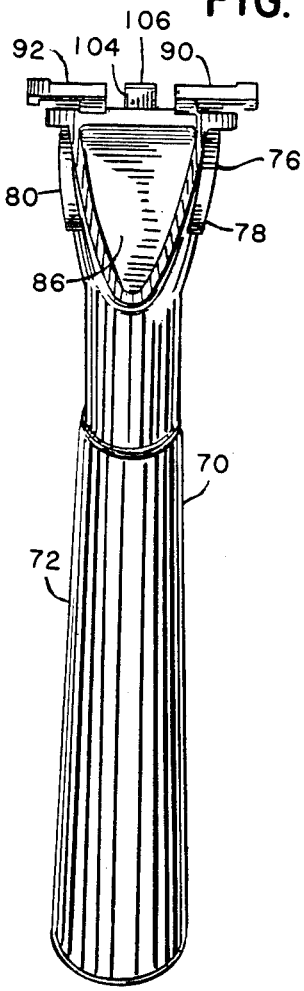
FIG. 8 is a back elevational view thereof.
Figure 9:
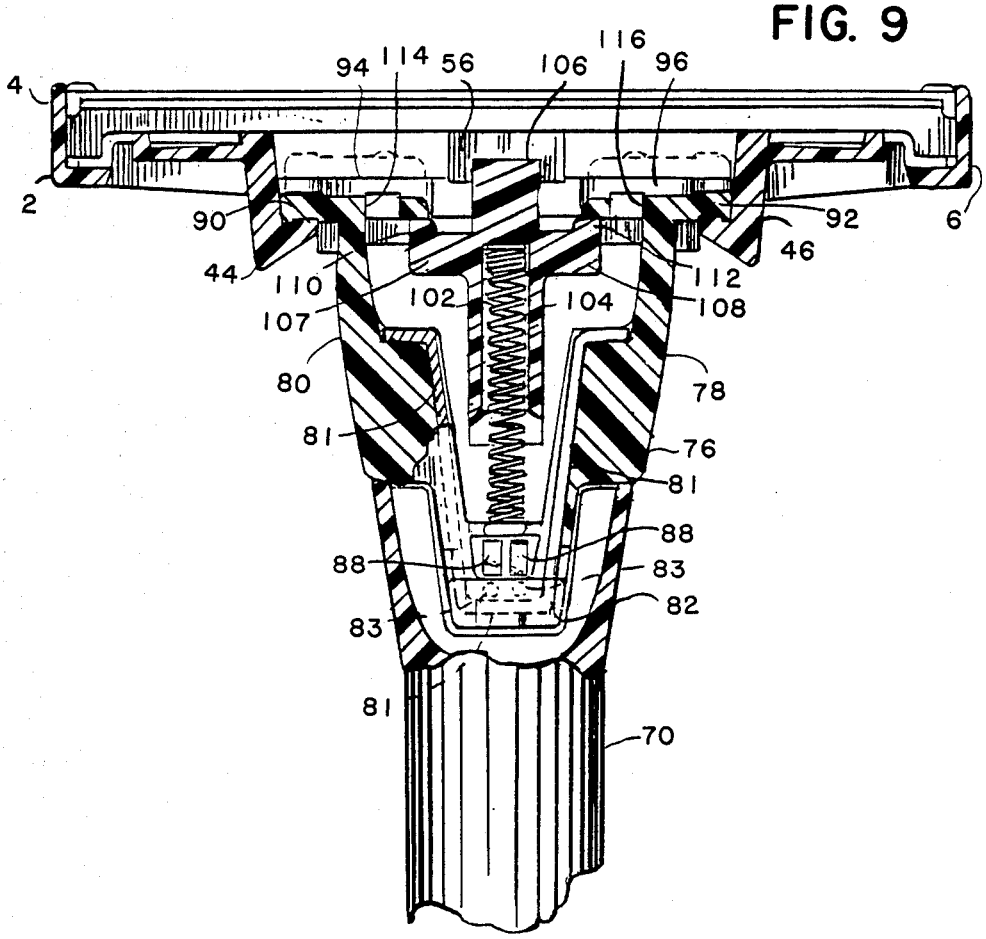
FIG. 9 is a sectional view of the blade assembly attached to the handle assembly, taken generally along the length-wise centerline of the blade assembly with parts broken away for greater clarity.
Figure 10:
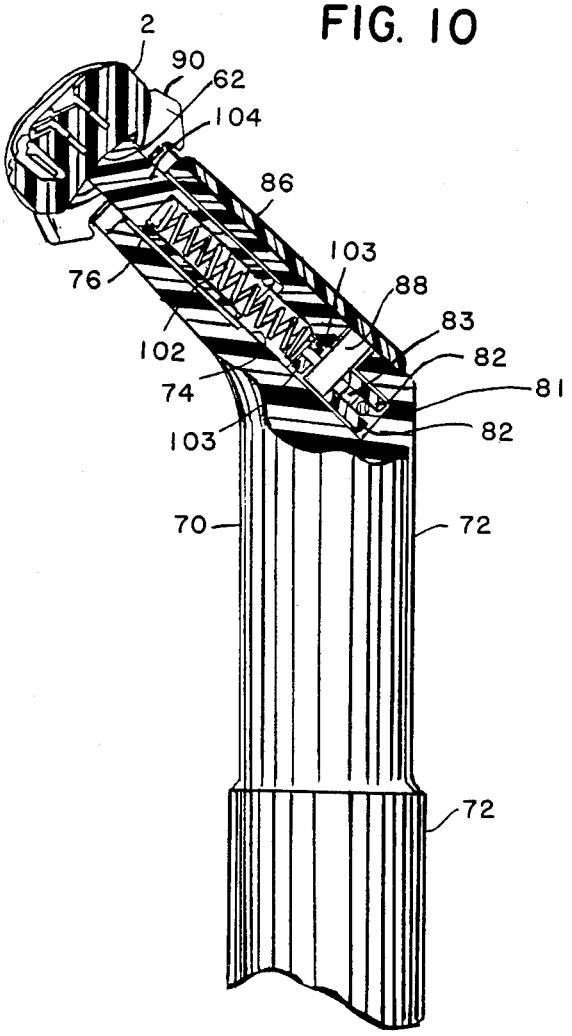
FIG. 10 is a sectional view of the blade assembly attached to the handle assembly, taken along the width-wise centerline of the blade assembly.

Referring to FIGS. 6–8, it will be seen that an illustrative embodiment of the invention includes a razor handle assembly 70 having a grip portion 72. One end of the grip portion 72 is provided with a recess 74 in which is disposed a molded plastic head portion 76 comprising two arms 78, 80 joined by connecting portions 82, which may be secured together by pins 83, as illustrated in FIGS. 9 and 10. The grip portion 72 is further provided with a cover member 86 including a pair of projections 88 which are disposed against the connecting portions 82 in a manner securely locking the head portion 76 to the grip portion 72. Each of the arms 78, 80 has disposed on its free end, respectively, a shell bearing 90, 92.

Referring again to FIG. 5, it will be seen that the blade assembly rails 48, 50, in conjunction with undersurfaces 94, 96 of the body member 2, and arcuate struts 95, 97, define arcuate slots 98, 100 adapted to receive the shell bearings 90, 92, respectively. Thus, the shell bearings 90, 92 comprise a shell bearing means which constitutes a pivot mounting means adapted to cooperate with the above described blade assembly pivot mounting means to facilitate pivotal connection of the blade assembly to the razor handle assembly (FIGS. 9 and 10).

In the handle recess 74, there is disposed a coil spring 102 and a plunger member 104, the spring biasing the plunger in the direction of the free end 106 of the plunger member 104. The coil spring 102 rests upon a pair of fingers 103 extending inwardly from the arms 78, 80. When the blade assembly is connected to the handle assembly, the free end 106 of the plunger member 104 is urged by the spring 102 into engagement with the blade assembly cam means 56. During pivoting operation of the blade assembly, the plunger end 106 bears against the cam surfaces 58, 60, to urge the blade assembly to a given position, the position in which the plunger end 106 rests at the apex 62 of the cam means 56.

Referring particularly to FIGS. 8 and 9, it will be seen that the arms 78, 80 extend beyond the sides of the handle and are accessible to an operator. The arms 78, 80 are biased outwardly by a leaf or wire spring 81 disposed in the head portion 76. To connect the blade assembly to the handle assembly, the operator presses the arms 78, 80 inwardly, toward each other, against the bias of the spring 81, moving the shell bearings 90, 92 toward each other.

The plunger member 104 is provided with oppositely extending arms 107, 108 (FIG. 9), each having upstanding therefrom a detent 110, 112. Each of the shell bearings 90, 92 is provided with an opening 114, 116 adapted to receive, respectively, the detents 110, 112. As the shell bearings 90, 92 are pressed inwardly toward one another, the openings 114, 116 align with the detents 110, 112, respectively. Upon such alignment, the spring 102 urges the plunger member 104, and thereby the detents 110, 112 upwardly, as viewed in FIG. 9, such that the detents 110, 112 enter the openings 114, 116, to lock the arms 78, 80 in an inwardly-flexed position. Upon release of the arms 78, 80 by the operator, the arms remain locked in the inwardly-flexed position.

Figure 3:
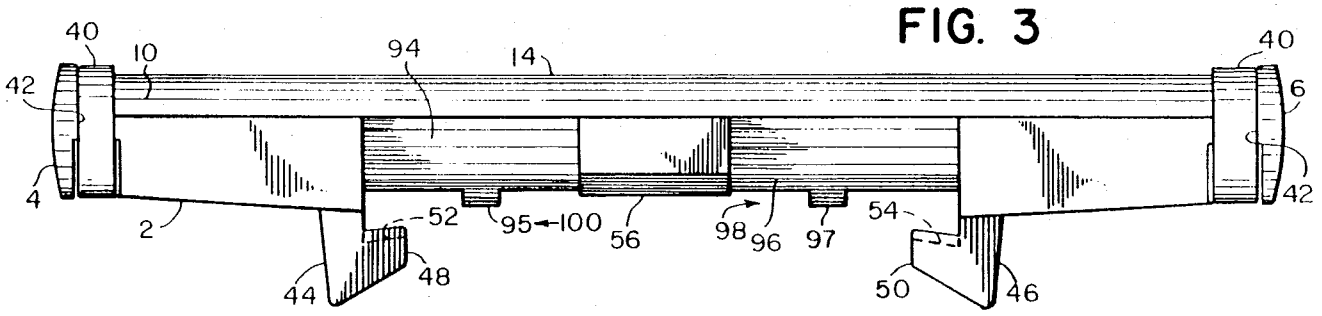
FIG. 3 is a back elevational view thereof.

The shell bearings 90, 92 are then pressed against the blade assembly underside arcuate struts 95, 97, forcing the plunger member 104 downwardly, as viewed in FIG. 9, and removing the detents 110, 112 from the openings 114, 116, the arms 78, 80 being thereby released. Upon release of the arms 78, 80, the arms spring outwardly in opposite directions away from each other, under the influence of the spring 81, the shell bearings 90, 92 entering the arcuate slots 98, 100 (FIG. 3). The spring biased plunger member 104 engages the cam means 56, seeking the apex 62 of the cam means and thereby urging the blade assembly to a "neutral" position.

During a shaving operation, the guard portion 24 and the blades 36, 36' move independently of each other against the bias of the spring fingers 18, 18'. Simultaneously, the blade assembly, as a whole, pivots on the handle, following the contours of the surface being shaved.

When it is desired to discard a used blade assembly, the operator need only compress the arms 78, 80, removing the shell bearings 90, 92 from the arcuate slots 98, 100 and releasing the blade assembly.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A razor handle assembly comprising a grip portion, a head portion at one end of said grip portion, the head portion having first and second arms movable toward and away from each other, a first shell bearing mounted on said first arm and a second shell bearing mounted on said second arm, said shell bearings being adapted to receive a razor blade assembly and to permit pivotal movement of said razor blade assembly on said handle assembly, a spring-biased plunger disposed in said head portion and extending between said first and second shell bearings, said plunger being reciprocally movable in said head portion, a free end of said plunger being adapted to engage an underside cam portion of said blade assembly to exercise a bias on said blade assembly and thereby urge said blade assembly to a given position on said shell bearings, first and second extensions protruding outwardly from said plunger, a detent upstanding from each of said extensions, each of said shell bearings having an opening therein adapted to receive, respectively, said detents, said spring being adapted to urge said detents into said openings when said arms are moved toward each other, to lock said arms in close proximity to each other, engagement of said plunger with said blade assembly being operative to remove said detents from said openings to permit said arms to move away from each other and said shell bearings to engage said blade assembly.

2. The razor handle assembly in accordance with claim 2, including a leaf spring member exercising a bias on said arms in directions outwardly from each other.

* * * * *